US007316057B2

(12) United States Patent
Seth

(10) Patent No.: US 7,316,057 B2
(45) Date of Patent: Jan. 8, 2008

(54) METHOD OF MANUFACTURING A ROTATING APPARATUS DISK

(75) Inventor: Brij Seth, Maitland, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 236 days.

(21) Appl. No.: 10/961,626

(22) Filed: Oct. 8, 2004

(65) Prior Publication Data

US 2006/0075624 A1 Apr. 13, 2006

(51) Int. Cl.
*B23P 25/00* (2006.01)

(52) U.S. Cl. ..... 29/458; 29/527.1; 29/527.3; 29/526.4; 29/526.3; 29/526.5; 428/577; 428/542.8; 75/10.24; 75/10.25

(58) Field of Classification Search ..... 29/889.2, 29/889.23, 458, 527.1, 527.2, 527.3, DIG. 5, 29/DIG. 10, DIG. 18, DIG. 31, DIG. 39, 29/526.3, 526.4, 526.5; 419/8, 28, 29; 148/516, 148/522, 527, 537, 555, 556; 164/477; 428/577, 680, 389, 542.8, 585; 75/10.24, 75/10.25

See application file for complete search history.

(56) References Cited

U.S. PATENT DOCUMENTS

| | | | | |
|---|---|---|---|---|
| 899,827 | A * | 9/1908 | Cutter | 205/151 |
| 3,940,268 | A | 2/1976 | Catlin | |
| 4,005,515 | A | 2/1977 | Sundt | |
| 4,152,816 | A | 5/1979 | Ewing et al. | |
| 4,203,705 | A | 5/1980 | Wesbecher | |
| 4,270,256 | A | 6/1981 | Ewing | |
| 4,479,293 | A * | 10/1984 | Miller et al. | 29/889.23 |
| 4,529,452 | A * | 7/1985 | Walker | 148/527 |
| 4,538,331 | A | 9/1985 | Egan et al. | |
| 4,581,300 | A | 4/1986 | Hoppin, III et al. | |
| 4,608,094 | A | 8/1986 | Miller et al. | |
| 4,636,124 | A | 1/1987 | Gugle et al. | |
| 4,680,160 | A | 7/1987 | Helmink | |
| 4,787,821 | A | 11/1988 | Cruse et al. | |
| 4,820,358 | A | 4/1989 | Chang | |
| 4,825,522 | A | 5/1989 | Iwai et al. | |

(Continued)

OTHER PUBLICATIONS

Advances in Net-Shape Powder Metallurgy: New manufacturing processes could lower turbine engine costs and improve performance and reliability. AFRL Technology Horizons, Feb. 2004, p. 33-34.

(Continued)

*Primary Examiner*—Jermie E. Cozart

(57) ABSTRACT

A method (20) of fabricating a large component such as a gas turbine or compressor disk (32) from segregation-prone materials such as Alloy 706 or Alloy 718 when the size of the ingot required is larger than the size that can be predictably formed without segregations using known triple melt processes. A sound inner core ingot (12) is formed (22) to a first diameter ($D_1$), such as by using a triple melt process including vacuum induction melting (VIM), electroslag remelting (ESR), and vacuum arc remelting (VAR). Material is than added (26) to the outer surface (16) of the core ingot to increase its size to a dimension ($D_2$) required for the forging operation (28). A powder metallurgy or spray deposition process may be used to apply the added material. The added material may have properties that are different than those of the core ingot and may be of graded composition across its depth. This process overcomes ingot size limitations for segregation-prone materials.

20 Claims, 1 Drawing Sheet

U.S. PATENT DOCUMENTS

| | | | | |
|---|---|---|---|---|
| 4,900,635 | A | | 2/1990 | Bowen et al. |
| 4,903,888 | A | | 2/1990 | Clark et al. |
| 4,958,431 | A | | 9/1990 | Clark et al. |
| 4,962,586 | A | | 10/1990 | Clark et al. |
| 5,106,012 | A | * | 4/1992 | Hyzak et al. ..... 228/265 |
| 5,161,950 | A | | 11/1992 | Krueger et al. |
| 5,253,978 | A | | 10/1993 | Fraser |
| 5,487,082 | A | * | 1/1996 | Takenouchi et al. ..... 373/42 |
| 5,561,827 | A | | 10/1996 | Reeves et al. |
| 5,688,108 | A | | 11/1997 | Dierksmeier et al. |
| 5,704,765 | A | | 1/1998 | Amos et al. |
| 5,746,579 | A | | 5/1998 | Amos et al. |
| 6,118,098 | A | | 9/2000 | Amos et al. |
| RE37,562 | E | | 2/2002 | Clark et al. |
| 6,491,208 | B2 | | 12/2002 | James et al. |
| 6,496,529 | B1 | | 12/2002 | Jones et al. |
| 6,709,771 | B2 | | 3/2004 | Allister |
| 6,719,858 | B2 | | 4/2004 | Bond et al. |

OTHER PUBLICATIONS

PR5520. Linear Friction Welding of Blisks for Gas Turbine Components. For: A Group of Sponsors. Sep. 2001. 4 pages.

* cited by examiner

METHOD OF MANUFACTURING A ROTATING APPARATUS DISK

FIELD OF THE INVENTION

This invention relates generally to the field of materials technology, and more particularly, to a method of fabricating a large component such as a gas turbine or compressor disk.

BACKGROUND OF THE INVENTION

The use of nickel-iron based super alloys to form disks for large rotating apparatus such as industrial gas turbines and compressors is becoming commonplace as the size and firing temperatures of such engines continue to increase in response to power, efficiency and emissions requirements. The requirement for integrity of such components demands that the materials of construction be free from metallurgical defects.

Turbine and compressor disks are commonly forged from a large diameter metal alloy preform or ingot. The ingot must be substantially free from segregation and melt-related defects such as white spots and freckles. Alloys used in such applications are typically refined by using a triple melt technique that combines vacuum induction melting (VIM), electroslag remelting (ESR), and vacuum arc remelting (VAR), usually in the stated order or in the order of VIM, VAR and then ESR. However, alloys prone to segregation, such as Alloy 706 (AMS Specification 5701) and Alloy 718 (AMS Specification 5663), are difficult to produce in large diameters by VAR melting because it is difficult to achieve a cooling rate that is sufficient to minimize segregation. In addition, VAR will often introduce defects into the ingot that cannot be removed prior to forging, such as white spots, freckles, and center segregation. Several techniques have been developed to address these limitations: see, for example, U.S. Pat. Nos. 6,496,529 and 6,719,858, incorporated by reference herein in their entireties.

Alternative methods such as powder metallurgy and metal spray forming are available for producing large diameter segregation free ingots, however, these methods have not been demonstrated as being commercially useful either for yielding acceptable properties or for their cost effectiveness. Accordingly, enhanced methods of producing large diameter preforms from segregation prone metallic materials are needed.

DETAILED DESCRIPTION OF THE INVENTION

A large ingot 10 including nickel-iron based superalloy material is formed by a process that will minimize the possibility of segregation and other melt related defects, and is thus well suited for subsequent forging operations. Ingot 10 includes an inner core portion or inner ingot 12 that may be formed using a traditional triple melt technique including vacuum induction melting (VIM), electroslag remelting (ESR), and vacuum arc remelting (VAR). Advantageously, the inner ingot 12 is formed to have a size wherein the triple melt technique or other technique used provides a sound ingot; that is, one uniform and free of a detrimental degree of microsegregation, macrosegregation and other solidification defects, even using segregation-prone materials such as Alloy 706 or Alloy 718. Depending upon the material and the particular process parameters selected, an inner ingot 12 having a dimension such as diameter $D_1$ as large as 30 inches or more may be produced using known triple melt techniques. Refining/casting techniques other than triple melt processes may be used to form the inner ingot 12 provided that the resulting ingot is substantially defect free in accordance with the design requirements of the particular application.

The ingot 10 further includes an outer portion 14 that is formed by adding material to the inner ingot 12 after the inner ingot 12 has been formed to form the final ingot 10 having a desired dimension. The outer portion 14 is added to build up the ingot 10 to the required dimension, such as diameter $D_2$, without the necessity of relying upon the triple melt process to produce an ingot of that dimension. In this manner, segregation-free ingots 10 may be produced that are larger than those that can be produced with a single prior art process that is prone to such defects, such as the prior art triple melt process alone, resulting in less scrap and therefore potentially lower overall cost for producing a large component.

Figure 1:
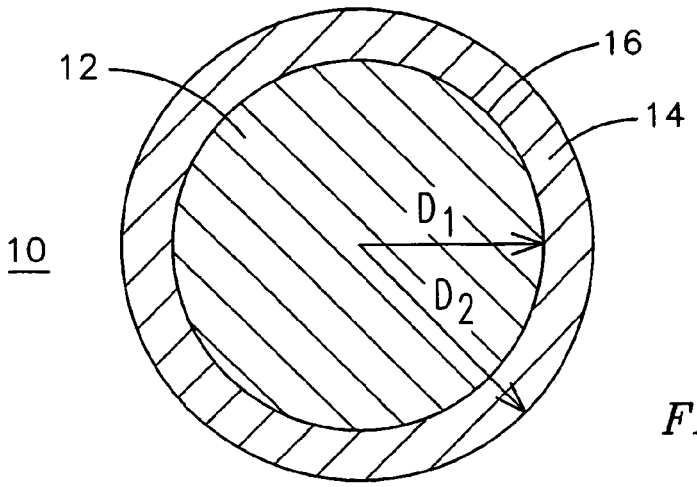
FIG. 1 is a cross-sectional view of an ingot having an inner core portion and an outer portion.
Figure 2:
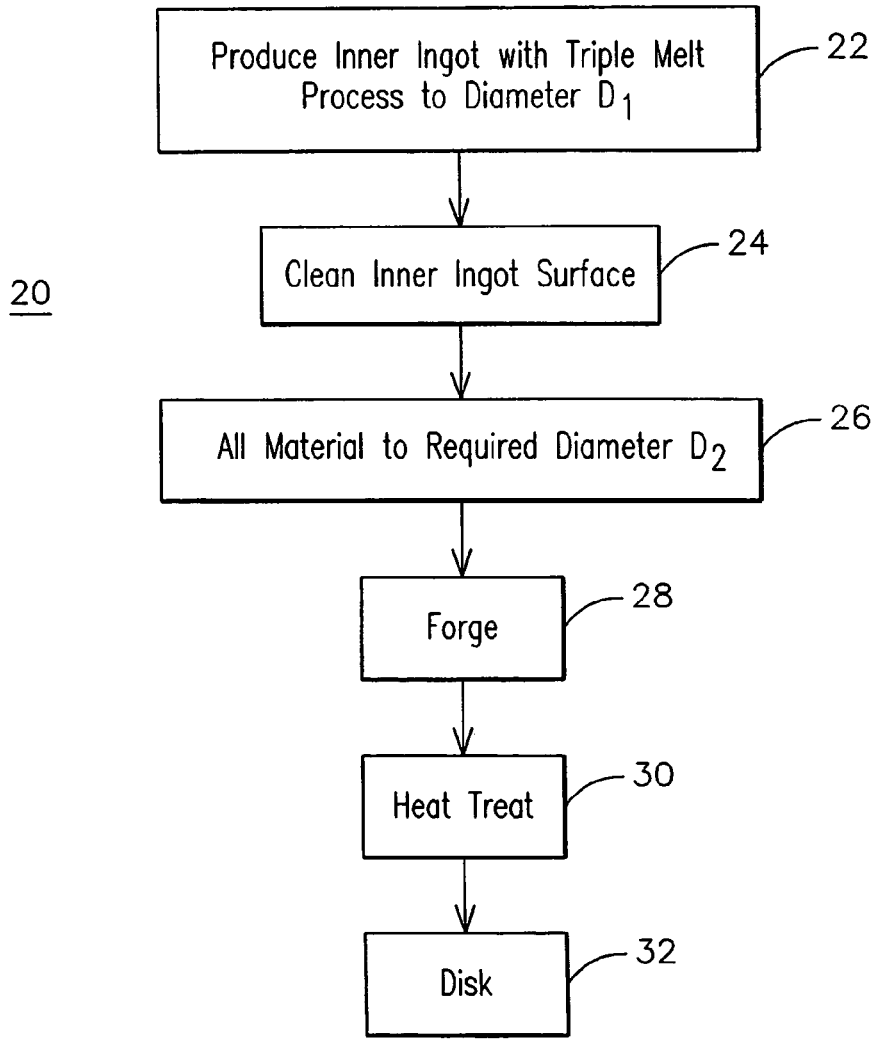
FIG. 2 is a flow diagram illustrating steps in a method of forming a rotating apparatus disk including forming the ingot of FIG. 1.

FIG. 2 illustrates steps in one method 20 that may be used to produce a large component such as a gas turbine or compressor disk utilizing the ingot 10 of FIG. 1. An inner ingot 12 is first produced at step 22 using a known triple melt process or other fabrication technique that provides a high level of assurance of acceptable metallurgical properties. The material, process and resulting ingot size are specifically selected in step 22 to provide a low risk of segregation or other defects when producing an ingot 12 having a dimension such as diameter $D_1$ that is less than a desired final ingot dimension.

The outer surface 16 of inner ingot 12 may then be cleaned, if desired, such as by machining or grit blasting at step 24 in preparation for a material addition step 26. Any appropriate material addition process is used at step 26 to increase the dimensions of the ingot from that achieved in step 22 to the required final dimension, such as a desired diameter $D_2$. The inner ingot 12 is used as a core to which material is joined to form larger ingot 10. Materials addition processes used in step 26 may include powder metallurgy or metal spray deposition, for example. A welding process may be used in step 26 in selected applications. If powder metallurgy is used, a hot isostatic pressing step may be included within materials addition step 26.

The final ingot 10 having the required dimension $D_2$ is then subjected to a forging process at step 28 to achieve a desired final shape. Heat-treating of the partially and/or fully formed component during or following the forging step 28 may be accomplished at step 30 as desired. The resulting component shape such as disk 32 is thus fabricated to have sound metallurgical properties in sizes that are larger than available with prior art techniques at comparable scrap rates.

There will be a degree of bonding that occurs between the inner core material 12 and the added material 14 along the surface 16, with the strength and type of bond depending upon the type of material addition process that is used in step 26. Advantageously, forging of the ingot 10 at an elevated temperature during step 28 may serve to improve the bond between the two layers 12, 14, creating a sound metallurgical bond.

It is known that the hub area of a turbine disk should have maximized resistance to low cycle fatigue cracking and crack propagation in order to ensure long turbine disk life. The hub area should also have good notch ductility to minimize the harmful effects of stress concentrations in critical regions. In contrast to the hub, tensile stress levels are lower in the rim area of a turbine disk, but operating temperatures are higher and creep resistance becomes an important consideration. The process of FIG. 2 permits the core ingot material 12 to be the same material or a different material than the added material 14, with the respective materials migrating to the hub and rim areas of the finished disk 32 during the forging step 28. For example, Alloy 718 material may be added to a core 12 of Alloy 706 material to achieve a disk having an Alloy 718 rim around an Alloy 706 hub. Furthermore, the added material 14 may be graded across its depth by varying the material or deposition process during material addition step 26. In a rotating apparatus disk embodiment, the graded added material 14 will migrate to form a rim region of the disk 32 having a graded material property across a radius of the disk. In one embodiment a graded layer 14 may be useful when applying a nickel-iron based superalloy material over a core ingot of a steel material such as 9Cr-1Mo steel or a NiCrMoV low alloy steel. For such an embodiment, the final ingot 10 and the resulting disk 32 would include a layer of added rim material 14 that is graded in composition from primarily the steel hub material in a region closest to the core ingot 12 to primarily a nickel-iron based superalloy material at its outmost region. The layer of material 14 would be graded in composition across its depth from a first percentage of the steel material and a first percentage of a nickel-iron based superalloy material closest to the core ingot 12 to a second percentage of the steel material and a second percentage of a nickel-iron based superalloy material remote from the core ingot to form a final ingot. Thus, the improved properties of the nickel-iron based superalloy material are obtained in the region where they are most needed without risking segregations or other defects that may occur when forming the entire disk out of the superalloy material using a triple melt process.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A method comprising:

forming a core ingot of nickel-iron based superalloy material to have a first dimension using a triple melt process comprising vacuum induction melting, electroslag remelting, and vacuum are remelting effective to inhibit segregation defects within the core ingot;

adding material to an outer surface of the core ingot using a second process effective to cause the material to bond to the core ingot and build up on itself to form a final ingot having a second dimension greater than the first dimension, the second process selected from the group consisting of powder metallurgy, metal spray deposition and welding; and forging the final ingot into a desired shape.

2. The method of claim 1, further comprising adding the material to the outer surface of the core ingot using a powder metallurgy process.

3. The method of claim 2, further comprising adding the material to the outer surface of the core ingot using a metal spray deposition process.

4. The method of claim 2, further comprising adding the material to the outer surface of the core ingot using a welding process.

5. The method of claim 1, further comprising:

forming the core ingot of a first material; and adding a second material different than the first material to the outer surface of the core ingot.

6. The method of claim 1, further comprising:

forming the core ingot of Alloy 706 material; and adding Alloy 718 as the added material to the outer surface of the core ingot.

7. The method of claim 1, further comprising the added material having a graded property across its depth to the outer surface of the core ingot.

8. The method of claim 1, wherein the triple melt process is completed before the second process is completed.

9. The method of claim 8, wherein the triple melt process is completed before the second process is begun.

10. The method of claim 1, wherein the added material builds up on itself via a continual application of added material particles over a period of time.

11. The method of claim 1, wherein the final ingot has a segregation defect inhibiting diameter greater than 30 inches.

12. A method of forming an ingot having a dimension that exceeds a first dimension at which a triple melt process will predictably produce a segregation-free metallurgy using a segregation-prone material, the method comprising:

forming a core ingot to no more than the first dimension using a triple melt process effective to inhibit segregation defects within the core ingot; and adding material to an outer surface of the core ingot using a second process effective to cause the material to bond to the core ingot and different than the triple melt process to form a final ingot having a second dimension larger than the first dimension.

13. The method of claim 12, further comprising forming the core ingot of one of Alloy 706 and Alloy 718 material.

14. The method of claim 12, further comprising adding the material to the outer surface of the core ingot using a powder metallurgy process.

15. The method of claim 12, further comprising adding the material to the outer surface of the core ingot using a metal spray deposition process.

16. The method of claim 12, further comprising the added material being different than the material of the core ingot to the outer surface of the core ingot.

17. The method of claim 12, further comprising the added material being graded in composition across its depth to the outer surface of the core ingot.

18. The method of claim 12, wherein the triple melt process is completed before the second process is completed.

19. The method of claim 12, wherein the second process is effective to cause the material to bond to the core ingot and build up on itself.

20. The method of claim 19, wherein, the second process is selected from the group consisting of powder metallurgy, metal spray deposition and welding.

* * * * *